US009827765B2

(12) United States Patent
Kihara

(10) Patent No.: US 9,827,765 B2
(45) Date of Patent: Nov. 28, 2017

(54) LIQUID EJECTION HEAD AND METHOD FOR MANUFACTURING THE SAME

(71) Applicant: CANON KABUSHIKI KAISHA, Tokyo (JP)

(72) Inventor: Hiroki Kihara, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/227,486

(22) Filed: Aug. 3, 2016

(65) Prior Publication Data

US 2017/0036444 A1 Feb. 9, 2017

(30) Foreign Application Priority Data

Aug. 5, 2015 (JP) ..... 2015-155097

(51) Int. Cl.
*B41J 2/14* (2006.01)
*B41J 2/16* (2006.01)

(52) U.S. Cl.
CPC ..... *B41J 2/1433* (2013.01); *B41J 2/1623* (2013.01); *B41J 2002/14362* (2013.01); *B41J 2002/14491* (2013.01)

(58) Field of Classification Search
CPC ..... B41J 2/1433; B41J 2/1623
See application file for complete search history.

(56) References Cited

U.S. PATENT DOCUMENTS

2013/0201249 A1* 8/2013 Hamada ..... B41J 2/01 347/20

FOREIGN PATENT DOCUMENTS

JP 2005-132102 A 5/2005

* cited by examiner

*Primary Examiner* — Jason Uhlenhake
(74) *Attorney, Agent, or Firm* — Canon U.S.A. Inc., IP Division

(57) ABSTRACT

As a sealing member to be disposed on the periphery of an element substrate, a cured substance of a first sealing material at least containing an epoxy resin, a curing agent, and a filler containing a silica filler and a silicone filler, the first sealing material having a filling amount of the filler of 40% by mass or more and having a difference between the median diameter of the silica filler and the median diameter of the silicone filler of 4.0 μm or less is used.

20 Claims, 4 Drawing Sheets

LIQUID EJECTION HEAD AND METHOD FOR MANUFACTURING THE SAME

BACKGROUND OF THE INVENTION

Field of the Invention

The present invention relates to a liquid ejection head for ejecting liquid, such as ink, from an ejection port and a method for manufacturing the same.

Description of the Related Art

A recording system by a liquid ejection head typified by an inkjet recording head gives thermal energy or vibration energy to liquid, such as ink, to eject the ink in the form of small liquid droplets from an ejection port to form an image on a recording medium.

As methods for manufacturing the liquid ejection head of this type, the following method is mentioned. First, an ejection energy generating element and a wiring conductor for supplying electric power to the ejection energy generating element are provided on a silicon substrate. Then, a protective film is provided on the wiring conductor, and then an ink flow passage and an ink ejection port are patterned using a resist as a mask. Next, a through hole (ink supply port) for supplying ink is opened from the back surface side of the silicon substrate to the front surface side on which the ejection energy generating element is provided to form a substrate (recording element substrate).

Then, the formed recording element substrate is stuck to a concave portion containing a support member containing alumina or the like, and then a lead of an electric wiring member bonded onto the support member and an electrode terminal of a wiring conductor end of the recording element substrate are electrically bonded to each other.

Next, a chip periphery sealing material is applied to a gap between the support member and the recording element substrate on the periphery of the recording element substrate. An ILB (inner lead bonding) sealing material which seals the electric connection portion is applied from the above. As a technique relating to the chip periphery sealing, a method described in Japanese Patent Laid-Open No. 2005-132102 is known.

Functions required in the chip periphery sealing material used herein which seals the periphery of the recording element substrate are as follows.

First, as the first point, it is required that, when the head is manufactured, the periphery sealing material flows in a short time through the gap having a width of a little less than 1 mm formed between the concave portion on the support member and the recording element substrate, so that the periphery sealing material is promptly filled into the entire periphery from the injection point thereof.

As the second point, it is required that corrosion of the electric connection portion, short circuit, and migration due to ink and other factors are prevented as the quality of the head.

As the third point, it is required that the element substrate is not deformed due to expansion and shrinkage of the sealing material. In the head having the above-described configuration, it is common to use a single crystal silicon for the recording element substrate. Since the periphery sealing material seals the periphery of the element substrate, the periphery sealing material having a large linear expansion coefficient further shrinks as compared with the element substrate having a very small linear expansion coefficient in an environment where the temperature is lower than the curing temperature of the periphery sealing material. When the periphery sealing material shrinks, force (tensile stress) is applied in a direction in which the periphery sealing material outwardly pulls the element substrate. When the shrinkage of the periphery sealing material is large, cracking may occur in the element substrate due to the tensile stress, which may make it impossible to perform good printing.

In order to reduce such tensile stress, it is advantageous to reduce the linear expansion and reduce the elasticity of the chip periphery sealing material. Therefore, a method of filling a large amount of a filler into the chip periphery sealing material is mentioned. For example, since a silica filler is an inorganic substance, the linear expansion coefficient is small. Thus, by filling a larger amount of the silica filler into the periphery sealing material containing a base resin which is an organic substance, the linear expansion coefficient can be further reduced. A silicone filler is a low elastic filler. Therefore, by filling a larger amount of the silicone filler into the periphery sealing material, the elasticity can be further reduced. However, high filling of the filler leads to a reduction in fluidity of the filler. As described above, since the periphery sealing material needs to promptly flow through a gap having a width of a little less than 1 mm, both high fluidity and high filling of the filler need to be achieved.

The silica filler and the silicone filler are usually mixed into the base resin forming the sealing material under heating or cooling as necessary with a planetary mixer, a triple roll, or the like. However, the silicone filler is viscous powder. Therefore, when the silicone filler is mixed with the base resin as it is, the silicone filler cannot be uniformly dispersed in the base resin, which leads to the formation of a sealing material having high viscosity and high thixotropy. Thus, the silicone filler cannot be used for the chip periphery sealing material which is required to have high fluidity in some cases.

Therefore, in order to uniformly disperse the silicone filler in the chip periphery sealing material, it is known that the uniform dispersion of the silicone filler can be achieved by the use of a dispersant.

Japanese Patent Laid-Open Nos. 2008-214479 and 2014-152310 describe dispersing the silicone filler without increasing the viscosity and the thixotropy using a dispersant.

In Japanese Patent Laid-Open No. 2008-214479, a viscosity reduction is achieved by the use of silicone oil as the dispersant (which is indicated as a compatibilization agent in Japanese Patent Laid-Open No. 2008-214479). In Japanese Patent Laid-Open No. 2014-152310, the viscosity is reduced by the use of a silane coupling agent as the dispersant.

SUMMARY OF THE INVENTION

According to one aspect of the present invention, a liquid ejection head has an element substrate having an ejection port configured to eject liquid, an electric wiring member electrically connected to an electric connection portion of the element substrate by a lead, a support member supporting the element substrate and the electric wiring member, and a sealing member for sealing the lead and the electric connection portion, in which the sealing member is disposed on the periphery of the element substrate and contains a first sealing member sealing the lead and the electric connection portion from below and a second sealing member sealing the lead and the electric connection portion from above the lead and the electric connection portion, and the first sealing member is a cured substance of a first sealing material containing an epoxy resin, a curing agent, and a filler containing a silica filler and a silicone filler, the first sealing material having a filling amount of the filler of 40% by mass or more and having a difference between the median diameter of the silica filler and the median diameter of the silicone filler of 4.0 μm or less.

According to one aspect of the present invention, a method for manufacturing a liquid ejection head having an element substrate having an ejection port for ejecting liquid, an electric wiring member electrically connected to an electric connection portion of the element substrate by a lead, a support member supporting the element substrate and the electric wiring member, and a sealing member for sealing the lead and the electric connection portion includes a process of applying a first sealing material to the periphery of the element substrate, and then curing the same to form a first sealing member and a process of applying a second sealing material from above the lead and the electric connection portion, and then curing the same to form a second sealing member, in which the first sealing material contains an epoxy resin, a curing agent, and filler containing a silica filler and a silicone filler, the first sealing member has a filling amount of the filler of 40% by mass or more of the entire sealing material, and has a difference between the median diameter of the silica filler and the median diameter of the silicone filler of 4.0 μm or less.

Further features of the present invention will become apparent from the following description of exemplary embodiments with reference to the attached drawings.

DESCRIPTION OF THE EMBODIMENTS

According to an examination of the present inventors, dispersants described in Japanese Patent Laid-Open Nos. 2008-214479 and 2014-152310 have reduced the insulation properties after the curing of sealing materials in many cases. More specifically, when materials having no reactivity, such as silicone oil, monofunctional materials, such as a silane coupling agent, and the like are present in the sealing material, the crosslink density of a base resin decreases and the percentage of water absorption and the like also become high. Moreover, some dispersants are ionic dispersants, and therefore, even when the addition amount is slight, there has been a tendency for the insulation properties to decrease.

The present invention aims at solving the above-described problems. More specifically, the present invention provides a liquid ejection head in which electric reliability and a viscosity reduction of a sealing material disposed around an element substrate are achieved, i.e., a liquid ejection head in which a filler is highly filled without using a dispersant if possible, a linear expansion reduction and an elasticity reduction of a sealing material are achieved, and deformation of the element substrate is suppressed.

Liquid Ejection Head

Next, as an example of a liquid ejection head in which an electrode portion is protected by a sealing material, an embodiment in the case of using an inkjet head and using a sealing material according to the present invention for the inkjet head to seal an electrode portion is described. Hereinafter, unless otherwise particularly specified, a substance in application, before curing, and indicated as a composition is referred to as a sealing material and a substance built in a part of an inkjet head as a bonding member and after curing is referred to as a sealing member.

Figure 1:
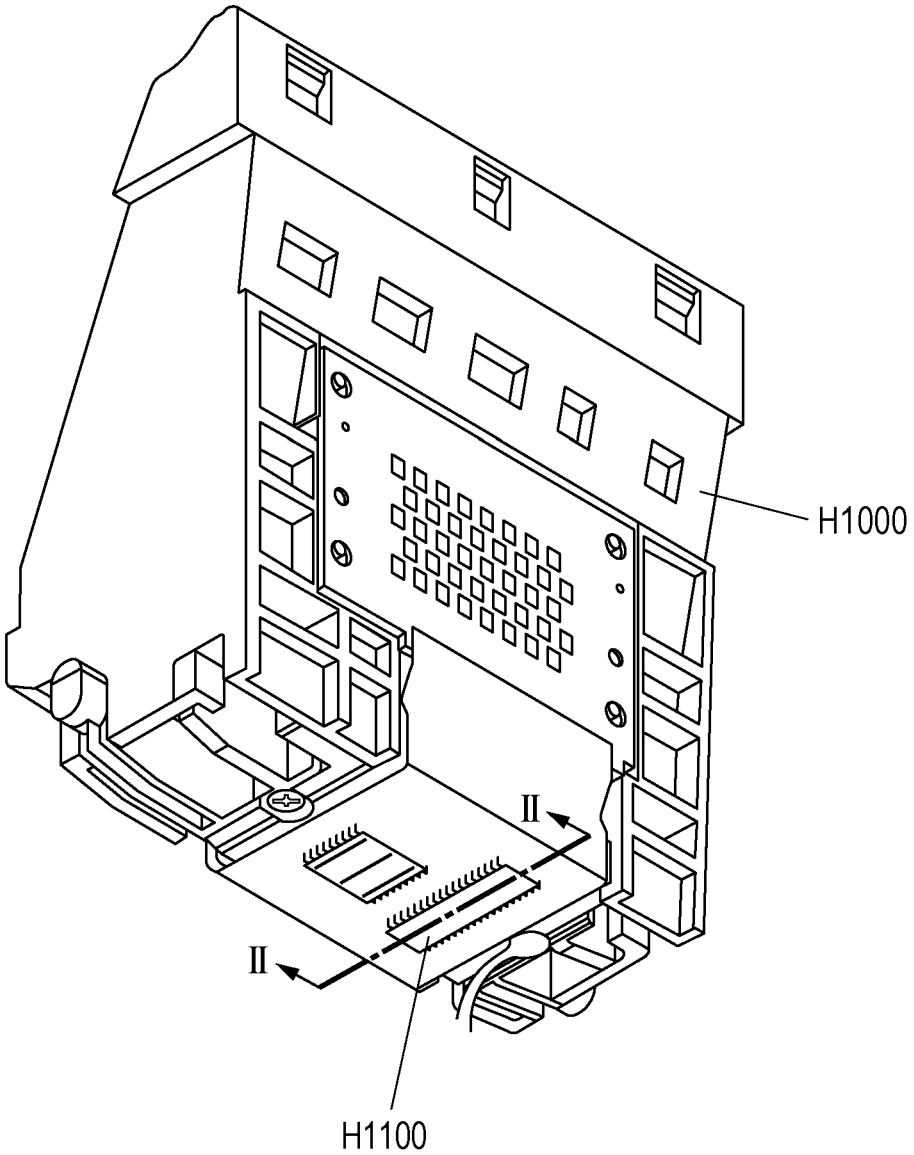
FIG. 1 is a perspective view illustrating an aspect of an inkjet head as an example of the liquid ejection head of the present invention.
Figure 2:
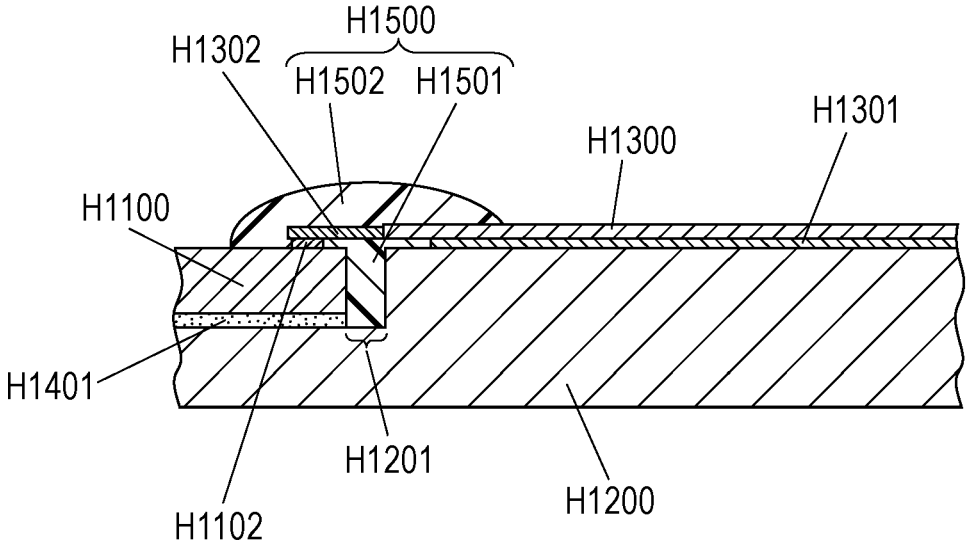
FIG. 2 is a cross-sectional enlarged view of an end in the longitudinal direction of a substrate in the cross section along the II-II line of FIG. 1.

An inkjet head H1000 illustrated in FIG. 1 has an element substrate H1100 having an ejection port ejecting liquid, such as ink. FIG. 2 is a cross-sectional enlarged view of an end in the longitudinal direction of the element substrate in the cross section along the II-II line of FIG. 1. In the element substrate H1100, an ejection port (not-illustrated), an energy generating element (not-illustrated) which generates energy to be utilized for ejection of ink, and an electronic circuit element (not-illustrated) for driving them are formed on the surface thereof. An electric connection portion (driving electrode H1102) provided on the end surface of the element substrate H1100 is electrically connected to a lead (connection electrode H1302) of an electric wiring member H1300 which supplies an electric control signal and a drive signal to the element substrate H1100.

The element substrate H1100 has an ink supply path which supplies ink to a flow passage continuous to the energy generating element. In a support member H1200, a portion supporting the element substrate H1100 forms a concave portion which is recessed to be lower than a portion supporting the electric wiring member H1300. In the concave portion of the support member H1200, the element substrate H1100 is fixed by a first adhesion member H1401. The electric wiring member H1300 is fixed and bonded to the outside of the concave portion of the support member H1200 by a second adhesion member H1301. A connection portion of the driving electrode H1102 and the connection electrode H1302 is covered with a sealing member H1500 containing a first sealing member H1501 and a second sealing member H1502 to be protected from ink and the like. The first sealing member H1501 is disposed in a gap H1201 where the inner wall of the concave portion of the support member H1200 and the side surface of the element substrate H1100 are separated from each other and the gap H1201 is formed in the periphery of the element substrate H1100. The periphery of the element substrate H1100 is sealed by the first sealing member H1501. The second sealing member H1502 seals a lead (connection electrode H1302) and the electric connection portion (driving electrode H1102) from above. In this case, the sealing material according to the present invention can be used for the first sealing member H1501.

Figure 3A:
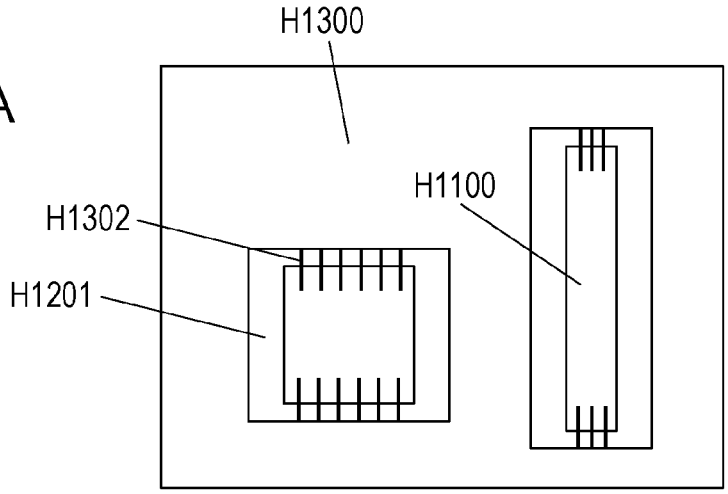
FIGS. 3A to 3C are top views for describing a manufacturing method in the inkjet head of the present invention.
Figure 3B:
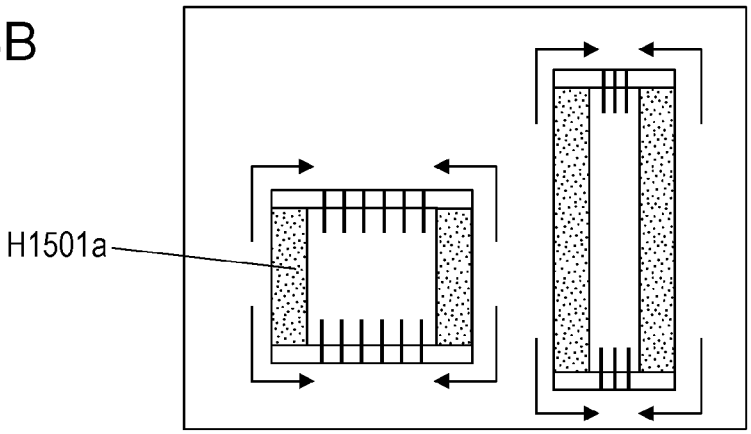
Figure 3C:
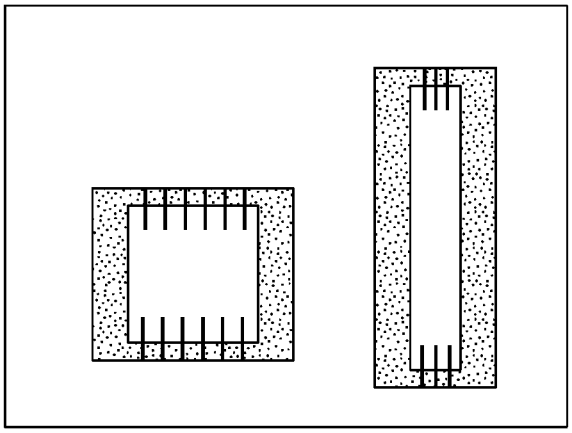

FIGS. 3A to 3C are schematic top views for describing an example of a manufacturing method including a process of covering an electrode portion with a sealing member in the inkjet head according to the present invention and are described below.

FIG. 3A illustrates a state where the ejection element substrate H1100 and the electric wiring member H1300 are stuck to the support member H1200 (not-illustrated) with an adhesive agent (not-illustrated), so that the connection electrode H1302 and the driving electrode H1102 (not-illustrated) are connected to each other. The lead (connection electrode H1302) crosses the gap H1201. The gap H1201 of the lead crossing portion is usually formed to be narrower than the gap H1201 other than the gap H1201 of the lead crossing portion. The gap H1201 of the lead crossing portion suitably has a width of 1 mm or less.

FIG. 3B illustrates a state where a first sealing material H1501*a* is applied to the gap H1201 between the two side surfaces of the element substrate H1100 on which the connection electrode H1302 is not disposed. This is because, when the first sealing material H1501*a* is applied to the side on which the connection electrode H1302 is disposed, air is trapped, so that the connection electrode cannot be sealed due to the accumulation of air bubbles.

FIG. 3C illustrates a state where the first sealing material H1501*a* flows to the side on which the connection electrode H1302 is disposed due to the fluidity of the sealing material 1501*a*.

Thereafter, the first sealing material H1501*a* is cured to be formed into the first sealing member H1501. Furthermore, materials of the second sealing member H1502 are applied, and then cured. The first sealing member H1501 and the second sealing member H1502 may be simultaneously cured. Alternatively, the first sealing member H1501 may be semi-cured, materials of the second sealing member H1502 may be applied, and then the first sealing member H1501 may be cured simultaneously with the curing of the second sealing member H1502. For example, the curing can be carried out by heat curing at 150° C. for several hours.

The same materials as those of the first sealing material H1501*a* can be used as the materials (second sealing material) of the second sealing member H1502. However, since it is not necessary to take fluidity and the like into consideration to an extent where the fluidity and the like are taken into consideration in the first sealing material H1501*a*, the material may be selected as appropriate in a range where the percentage of water absorption and the like are hardly affected. The second sealing material may contain the same silica filler and the same silicone filler as the filler and the median diameter difference therebetween is also not limited. As described in Japanese Patent Laid-Open No. 2005-132102, those having hardness after curing higher than that of the first sealing material can be suitably used for the second sealing material. When the second sealing material is applied before the first sealing material is cured, a region where the compositions are mixed may be formed without forming a clear interface. Although it is suitable to provide the second sealing member, the second sealing member is not always required and the liquid ejection head may have only the first sealing member.

The support member H1200 is provided with a liquid supply port (not-illustrated) communicating with a liquid supply path (not-illustrated) of the element substrate H1100. Particularly when the liquid supply path of the element substrate is a through hole penetrating the element substrate, the liquid supply port opens into the concave portion where the element substrate is disposed.

Hereinafter, the first sealing material for use in the liquid ejection head according to the present invention is described.

The first sealing material in the present invention at least contains an epoxy resin, a curing agent, a silica filler, and a silicone filler.

As the epoxy resin, an alicyclic epoxy resin, an aromatic epoxy resin, an aliphatic epoxy resin, and the like can be used.

The following substances are mentioned as the alicyclic epoxy resin.

Mentioned are cyclohexene oxide structure containing compounds obtained by epoxidizing polyglycidyl ether or cyclohexene of polyhydric alcohol having at least one alicyclic ring or a cyclopentene ring containing compound with an oxidizing agent or vinylcyclohexane oxide structure containing compounds obtained by epoxidizing a cyclopentene oxide structure containing compound or a compound having a vinylcyclohexane structure with an oxidizing agent. Examples thereof include, for example, hydrogenated bisphenol A diglycidyl ether, 3,4-epoxycyclohexylmethyl-3,4-epoxycyclohexane carboxylate, 3,4-epoxy-1-methylcyclohexyl-3,4-epoxy-1-methylcyclohexane carboxylate, 6-methyl-3,4-epoxycyclohexylmethyl-6-methyl-3,4-epoxycyclohexane carboxylate, 3,4-epoxy-3-methylcyclohexylmethyl-3,4-epoxy-3-methylcyclohexane carboxylate, 3,4-epoxy-5-methylcyclohexylmethyl-3,4-epoxy-5-methylcyclohexane carboxylate, 2-(3,4-epoxycyclohexyl-5,5-spiro-3,4-epoxy)cyclohexane-methadioxane, bis(3,4-epoxycyclohexylmethyl)adipate, vinylcyclohexene dioxide, 4-vinylepoxycyclohexane, bis(3,4-epoxy-6-methylcyclohexylmethyl)adipate, 3,4-epoxy-6-methylcyclohexylcarboxylate, methylenebis(3,4-epoxycyclohexane), dicyclopentadiene diepoxide, ethyleneglycol di(3,4-epoxycyclohexylmethyl)ether, ethylenebis(3,4-epoxycyclohexane carboxylate), epoxy hexahydrophthalic acid dioctyl, epoxy hexahydrophthalic acid di-2-ethylhexyl, and the like.

The following substances are mentioned as specific examples of the aromatic epoxy resin.

Examples thereof include polyhydric phenols having at least one aromatic ring or polyglycidyl ethers of alkylene oxide adducts thereof, e.g., bisphenol A, bisphenol F, or glycidyl ether, epoxy novolak resin, bisphenol A novolac diglycidyl ether, and bisphenol F novolac diglycidyl ether which are compounds obtained by further adding alkylene oxide thereto, and the like.

The following substances are mentioned as specific example of the aliphatic epoxy resin.

Examples thereof include aliphatic polyhydric alcohols or polyglycidyl ethers of alkylene oxide adducts thereof, polyglycidyl esters of long-chain aliphatic polybasic acids, epoxy group containing compounds obtained by oxidizing long-chain aliphatic unsaturated hydrocarbons with an oxidizing agent, homopolymers of glycidyl acrylates or glycidyl methacrylates, copolymers of glycidyl acrylates or glycidyl methacrylates, and the like. Examples of typical compounds include glycidyl ethers of polyhydric alcohols, such as 1,4-butanediol diglycidyl ether, 1,6-hexanediol diglycidyl ether, triglycidyl ether of glycerine, triglycidyl ether of trimethylolpropane, tetraglycidyl ether of sorbitol, hexaglycidyl ether of dipentaerythritol, diglycidyl ether of polyethylene glycol, and diglycidyl ether of polypropylene glycol, polyglycidyl ethers of polyether polyols obtained by adding one or two or more alkylene oxides to aliphatic polyhydric alcohols, such as propylene glycol and glycerine, and diglycidyl esters of long-chain aliphatic dibasic acids.

Further, monoglycidyl ethers of aliphatic higher alcohols, phenol, cresol, butylphenol, monoglycidyl ethers of polyether alcohols obtained by adding alkylene oxide thereto, glycidyl esters of higher fatty acids, epoxidized soybean oil, epoxy octyl stearate, epoxy butyl stearate, epoxidized linseed oil, and the like are mentioned.

As the base resin of the sealing material, an acrylic resin, a styrene resin, modified substances thereof, and the like may be used. Those having an epoxy group in the molecules are excellent in chemical resistance, and therefore are particularly suitable.

As the curing agent, known curing agents for epoxy resin can be used and amine-series hardening agents, acids, and acid anhydride-based curing agents are suitable.

Examples of the amine-series hardening agent include aliphatic amines, such as ethylenediamine (EDA), diethylenetriamine (DETA), triethylenetetramine (TETA), tetraethylenepentamine (TEPA), dipropylenediamine (DPDA), diethylaminopropylamine (DEAPA), and hexamethylenediamine (HMDA); alicyclic amines, such as menthenediamine (MDA), isophoronediamine (IPDA), bis(4-amino-3-methyldicyclohexyl)methane, diaminodicyclohexylmethane, bis(aminomethyl)cyclohexane, N-aminoethylpiperazine, and 3,9-bis(3-aminopropyl-2,4,8,10-tetraoxaspiro[5.5]undecane; aliphatic aromatic amines, such as m-xylenediamine, aromatic amines, such as meta-phenylenediamine (MPDA), diaminodiphenylmethane (DDM), diaminodiphenylsulfone (DDS), and diaminodiethyldiphenylmethane; polyaminoamides, and the like.

Examples of acid and acid anhydride curing agents include aliphatic acid anhydrides, such as dodecenyl succinic anhydride (DDSA), polyadipic anhydride (PADA), polyazelaic anhydride (PAPA), polysebacic anhydride (PSPA), poly(ethyloctadecanedioic) anhydride (SB-20AH), and poly(phenylhexadecanedioic) anhydride (ST-2PAH); alicyclic acid anhydrides, such as methyltetrahydrophthalic anhydride (Me-THPA), methylhexahydrophthalic anhydride (Me-HHPA), methylhimic anhydride (MHAC), hexahydrophthalic anhydride (HHPA), tetrahydrophthalic anhydride (THPA), trialkyltetrahydrophthalic anhydride (TATHPA), and methylcyclohexenecarboxylic acid (MCTC); aromatic anhydrides, such as phthalic anhydride (PA), trimellitic anhydride (TMA), pyromellitic anhydride (PMDA), benzophenonetetracarboxylic anhydride (BTDA), and ethylene glycol bistrimellitate dianhydride (TMEG); and halogen-based acid anhydrides, such as HET anhydride (HET) and tetrabromophthalic anhydride (TBPA).

In addition thereto, curing agents, such as resole-type phenolic resin having a hydroxyl group of epoxy resin as a crosslinking point, urea resin, melamine resin, isocyanates, and block isocyanates, are mentioned.

In addition thereto, amine-adduct or epoxy-adduct type curing agents in which a curing agent is covered with the main material or a resin of the same type or the main material is covered with a curing agent, and the covering material melts by the heat in curing to thereby initiate curing of the main material and the curing agent can also be used.

For the sealing material according to the present invention, various kinds of additives, such as a surface regulator, a bubble dissipation agent, and a flame retardant, can be used as necessary.

The silica filler is not particularly limited and, for example, those having a spherical shape and an amorphous shape, fused silica, crystalline silica, and the like can be used. The spherical-shaped fused silica is particularly suitable from the viewpoint of filling properties or fluidity as compared with other silica fillers.

The silicone filler is suitably one or more kinds selected from a silicone rubber filler, a covering type silicone filler, and a silicone resin filler. The silicone rubber filler is fine powder of silicone rubber in which linear dimethyl polysiloxane is crosslinked. The silicone resin filler is fine powder of a polyorgano silsesqui oxane cured substance having a structure in which a siloxane bond is crosslinked in the shape of a three-dimensional net represented by $(RSiO_{3/2})n$. The covering type silicone filler is fine powder in which the surface of spherical silicone rubber powder is covered with a silicone resin. Among the above, the silicone resin filler has good compatibility with organic resin, and therefore is more suitable.

The sealing material according to the present invention may contain fillers other than the silica filler and the silicone filler in a range where the effects of the present invention are not impaired. As the other fillers, non-electrical conductive carbon black, titanium oxide, kaolin, clay, calcium carbonate, talc, alumina, aluminum nitride, and the like can be used and those which are not described herein can also be used. The fillers may be in any state, such as a pulverized state, a crushed state, and a spheroidized state by solution polymerization.

The filling amount (ratio of the mass of the filler filled into the sealing material to the mass of the completed sealing material) of the filler containing the silica filler and the silicone filler in the sealing material varies depending on the type or the shape of the filler to be filled. In order to develop the linear expansion reduction effect, the filling amount is suitably 40% by mass or more of the entire sealing material. However, when the filling amount is excessively large, the fluidity is lost. Therefore, the filling amount is suitably 75% by mass or less of the entire sealing material. In the filler, the total proportion of the silica filler and the silicone filler is preferably 90% by mass or more and more preferably 95% by mass or more. It is still more preferable that other fillers are not contained, i.e., the total proportion of the silica filler and the silicone filler is 100% by mass. Among the above, the use ratio of the silica filler to the silicone filler is preferably 35 or more and 111 or less and more preferably 40 or more and 60 or less in terms of mass ratio (Silica filler/Silicone filler).

The average particle diameter (Median diameter (D50)) of the filler can be determined from the cumulative number of 50% using a commercially-available laser diffraction/scattering type particle size distribution meter.

Figure 4A:
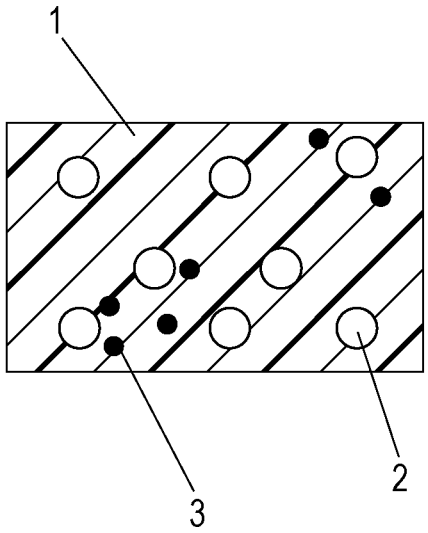
FIG. 4A is a dispersion state view of a first sealing material of Comparative Example and FIG. 4B is a dispersion state view of a first sealing material according to the present invention.
Figure 4B:
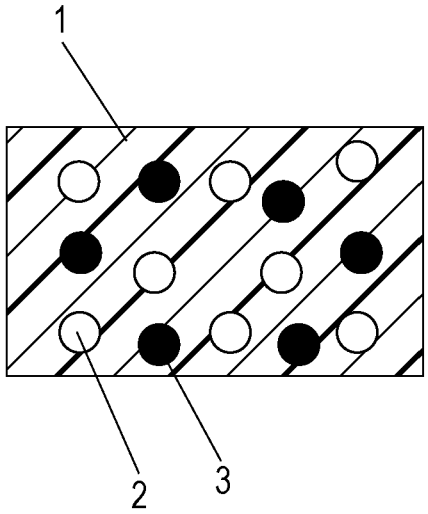

In the present invention, since a dispersant is not used as much as possible for the dispersion of the silica filler and the silicone filler in the sealing material, the median diameter difference between the silica filler and the silicone filler needs to be 4.0 μm or less. When the difference is larger than 4.0 μm, silicone fillers 3 cannot be uniformly dispersed in a base resin 1 as illustrated in FIG. 4A, so that the viscosity and the thixotropy become high, and therefore the sealing material cannot flow into the gap having a width of a little less than 1 mm described above. Therefore, the difference needs to be 4.0 μm or less and is particularly suitably 2.0 μm or less. More specifically, when the median diameter difference between silica fillers 2 and the silicone fillers 3 is 4.0 μm or less, both the fillers can be uniformly dispersed without any deviation in the base resin 1 as illustrated in FIG. 4B, so that a high-fluidity sealing material is obtained, and therefore the sealing material can flow into the gap having a width of a little less than 1 mm described above.

The median diameter of the silica filler is not particularly limited and is suitably 1 μm or more and 20 μm or less. The median diameter of the silicone filler is not particularly limited and is also suitably 1 μm or more and 20 μm or less. When the particle diameter is larger, an increase in viscosity is further suppressed. Therefore, the particle diameter is suitably larger from the viewpoint of fluidity.

It is suitable not to use the dispersant to be used for dispersing the silica filler and the silicone filler into a sealing material component in the sealing material according to the present invention. This is because there is a tendency for the electric reliability to sharply decrease when the dispersant is contained as described above. However, it is permitted to contain the dispersant insofar as the dispersant is a dispersant or has an amount ratio which does not impair the effects of the present invention. Even when the dispersant is blended in the sealing material, the content of the dispersant in the sealing material is suitably set to 0.1% by mass or less.

The following substances are mentioned as the dispersant. Examples of a surfactant type include an alkyl sulfonic acid type, a quaternary ammonium type, a higher alcohol alkylene oxide type, a polyhydric alcohol ester type, and an alkyl polyamine type. Examples of a polymer type include a polycarboxylic acid type, a naphthalene sulfonic acid type, polyethylene glycol, a polyether type, a polyalkylene polyamine type, and the like. As an inorganic dispersion type, a polyphosphate salt type is mentioned. As a silicone type, silicone oil, a silane type, and the like are mentioned.

Examples

Hereinafter, the present invention is described in detail with reference to Examples and Comparative Examples but the present invention is not particularly limited to these Examples. In the following description, "part(s)" means a "part(s) by mass".

As an example of the sealing material according to the present invention, sealing materials were prepared according to the compositions shown in Table 1. The name of each article in Table 1 is as follows.

Epoxy Resin

Bisphenol A type epoxy resin: Manufactured by Mitsubishi Chemical Corporation, Trade name "EPICOAT 828"

Bisphenol F type epoxy resin: Manufactured by Mitsubishi Chemical Corporation, Trade name "EPICOAT 807"

Alicyclic epoxy resin: Manufactured by DAICEL CHEMICAL INDUSTRIES, Trade name "CELLOXIDE 2021P"

Curing Agent 3- or 4-hexahydro phthalic anhydride: Manufactured by Hitachi Chemical Co., Ltd., Trade name "HN5500"

Liquid phenol novolak: Manufactured by MEIWA PLASTIC INDUSTRIES, LTD., Trade name "MEH8005"

Curing Catalyst

Imidazole: Manufactured by Shikoku Chemicals Corporation, Trade name "CUREZOL 2EMZ"

Silicone Filler

Silicone resin filler: Manufactured by Momentive Performance Materials Inc., Trade name "Tospearl 1110", D50=11.0 μm Covering type silicone filler: Manufactured by Shin-Etsu Silicone, Trade name "KMP-601", D50=12.0 μm Silicone rubber filler: Manufactured by Shin-Etsu Silicone, Trade name "KMP-598", D50=13.0 μm Silica Filler Fused silica 1: Manufactured by Denka Company Limited, Trade name "FB-12D", D50=11.2 μm Fused silica 2: Manufactured by Denka Company Limited, Trade name "FB-400FD", D50=12.8 μm Fused silica 3: Manufactured by TATSUMORI LTD., Trade name "MSS-7", D50=7.5 μm Fused silica 4: Manufactured by Denka Company Limited, Trade name "FB-950XFD", D50=14.5 μm Fused silica 5: Manufactured by Denka Company Limited, Trade name "FB-975XFD", D50=15.5 μm Fused silica 6: Manufactured by Denka Company Limited, Trade name "FB-302X", D50=6.2 μm Dispersant Alkoxysilane: Manufactured by Shin-Etsu Eilicone, Trade name "KBE-13"

TABLE 1

| | | Examples (part(s)) | | | | | | | | | | | Comparative Examples (part(s)) | | | | |
|---|---|---|---|---|---|---|---|---|---|---|---|---|---|---|---|---|---|
| Items | Product name | 1 | 2 | 3 | 4 | 5 | 6 | 7 | 8 | 9 | 10 | 11 | 1 | 2 | 3 | 4 | 5 |
| Epoxy resin | Bisphenol A type epoxy resin | 100 | 100 | 100 | 100 | 100 | 100 | 100 | 100 | | 50 | 100 | 100 | 100 | 100 | 100 | 100 |
| | Bisphenol F type epoxy resin | | | | | | | | | 100 | | | | | | | |
| | Alicyclic epoxy resin | | | | | | | | | | 50 | | | | | | |
| Curing agent | 3- or 4-hexahydro phthalic anhydride | 79 | 79 | 79 | 79 | 79 | 79 | 79 | 79 | 100 | 100 | | 79 | 79 | 79 | 79 | 79 |
| | Liquid phenol novolak | | | | | | | | | | | 70 | | | | | |
| Curing catalyst | Imidazole | 1 | 1 | 1 | 1 | 1 | 1 | 1 | 1 | 1 | 1 | 1 | 1 | 1 | 1 | 1 | 1 |
| Silicone filler | Silicone resin filler (D50 = 11.0 μm) | 5 | 5 | 5 | 5 | 3 | 7 | | | 5 | 5 | 5 | 5 | 5 | 5 | | 5 |
| | Covering type silicone filler (D50 = 12.0 μm) | | | | | | | 5 | | | | | | | | | |
| | Silicone rubber filler (D50 = 13.0 μm) | | | | | | | | 5 | | | | | | | | |
| Silica filler | Fused silica 1 (D50 = 11.2 μm) | 270 | | | | 335 | 220 | 270 | 270 | 270 | 270 | 270 | | | | | |
| | Fused silica 2 (D50 = 12.8 μm) | | 270 | | | | | | | | | | | | | | |
| | Fused silica 3 (D50 = 7.5 μm) | | | 270 | | | | | | | | | | | | | |
| | Fused silica 4 (D50 = 14.5 μm) | | | | 270 | | | | | | | | | | | | |
| | Fused silica 5 (D50 = 15.5 μm) | | | | | | | | | | | | 270 | | | | 270 |
| | Fused silica 6 (D50 = 6.2 μm) | | | | | | | | | | | | | 270 | | 270 | |
| Dispersant | Alkoxysilane | | | | | | | | | | | | | | | | 0.1 |

All the sealing materials shown in Table 1 were evaluated for the ion migration resistance by the following test.

Ion Migration Resistance

The sealing material was applied to a substrate formed by disposing two copper electrodes at an interval of 40 μm in such a manner that the thickness from the electrode surface is 600 μm, and then both the electrodes were covered. This sample was stored at 120° C. at a humidity of 100% while applying a voltage of 25 V to both the electrodes. The storage time until a metal precipitate was formed on the negative electrode side due to migration, and then one end thereof reaches the other electrode to cause short circuit between both the electrodes was evaluated according to the following criteria. The results are shown in Table 2.

A: 100 hours or more

B: Less than 100 hours

Examples and Comparative Examples in Inkjet Head

Inkjet heads were manufactured using the sealing materials of the compositions of Examples 1 to 11 and Comparative Examples 1 to 5 (shown in Table 1) for the first sealing material in the example of the inkjet head described above. The creep property and the thermal shock test were evaluated according to the following criteria. The results are shown in Table 2.

Creep Property

The sealing material was applied, and then it was investigated whether the sealing material crept to the lead portion. The gap H1201 of the lead portion was 2 mm.

S: Crept to a lead lower portion within 5 minutes.

A: More than 5 minutes was taken for creeping into a lead lower portion.

C: Not crept to a lead lower portion.

Thermal Shock Test

The inkjet heads of Examples and Comparative Examples were subjected to a thermal shock test in a range from −30° C. to 100° C. It was investigated whether or not cracking occurred in the recording element substrate under an electron microscope.

A: No cracking occurred.

B: Cracking occurred.

TABLE 2

| | Electric reliability | Creep property | Thermal shock test |
|---|---|---|---|
| Ex. 1 | A | S | A |
| Ex. 2 | A | S | A |
| Ex. 3 | A | A | A |
| Ex. 4 | A | A | A |
| Ex. 5 | A | S | A |
| Ex. 6 | A | S | A |
| Ex. 7 | A | A | A |
| Ex. 8 | A | A | A |
| Ex. 9 | A | S | A |
| Ex. 10 | A | S | A |
| Ex. 11 | A | S | A |
| Comp. Ex. 1 | A | C | A |
| Comp. Ex. 2 | A | C | A |
| Comp. Ex. 3 | A | C | C |
| Comp. Ex. 4 | A | S | C |
| Comp. Ex. 5 | B | S | A |

Results

Creep Property

In Examples 1 to 6, the silicone resin filler is used. In particular, since the median diameter difference between the silicone resin filler and the silica filler was 2.0 μm or less in Examples 1, 2, 5, and 6, both the fillers was able to be uniformly dispersed, and the viscosity was 30 Pas or less and the thixotropy was 1.4 or less. Therefore, the sealing materials crept to the connection electrode side within 5 minutes. In Examples 3 and 4, the median diameter difference between the silicone resin filler and the silica filler was larger than 2.0 μm, and thus it took more than 5 minutes for the sealing materials to creep to the connection electrode side but the sealing materials finally crept thereto. In Examples 7 and 8, the covering type silicone filler and the silicone rubber filler were used as the silicone filler type. Since the viscosity of both the fillers was higher than that of the silicone resin filler type, it took more than 5 minutes for the sealing materials to creep to the lead lower portion but the sealing materials finally crept thereto.

In Examples 9 to 11, the epoxy resin and the curing agent were changed from those of Examples 1 to 8 but the creep property was good.

In Comparative Examples 1 to 2, since the median diameter difference between the silicone filler and the silica filler was larger than 4.0 μm, the viscosity was high (larger than 30 Pas) and the thixotropy was high (larger than 2), so that the sealing materials finally did not creep under the lead. In Comparative Example 3, since only the silicone filler was used, the dispersibility of the filler deteriorates, so that the sealing material finally did not creep under the lead.

Thermal Shock Test

In Examples 1 to 11 and Comparative Examples 1, 2, and 5, since the silica filler and the silicone filler were filled, the linear expansion was reduced and the elasticity was reduced, so that cracking was not observed in the recording element substrate. In Comparative Examples 3 and 4, since either the silica filler or the silicone filler was not filled, cracking occurred.

Electric Reliability

In Comparative Example 5, the median diameter difference between the silicone resin filler and the silica filler was larger than 4.0 μm but the dispersant was used, and therefore the viscosity was reduced to be low and the creep property was good. However, the dispersant promoted migration, so that the electric reliability became poor.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-155097 filed Aug. 5, 2015, which is hereby incorporated by reference herein in its entirety.

What is claimed is:

1. A liquid ejection head comprising:

an element substrate having an ejection port configured to eject liquid;

an electric wiring member electrically connected to an electric connection portion of the element substrate by a lead;

a support member supporting the element substrate and the electric wiring member; and a sealing member for sealing the lead and the electric connection portion, wherein:

the sealing member contains a first sealing member sealing a periphery of the element substrate and a second sealing member sealing the lead and the electric connection portion from above the lead and the electric connection portion, the first sealing member is a cured substance of a first sealing material containing an epoxy resin, a curing agent, and a filler, the filler containing a silica filler and a silicone filler, and the first sealing material has a filling amount of the filler of 40% by mass or more and has a difference between a median diameter of the silica filler and a median diameter of the silicone filler of 4.0 μm or less.

2. The liquid ejection head according to claim 1, wherein the silicone filler is a silicone rubber filler, a covering type silicone filler, a silicone resin filler, or any combination thereof.

3. The liquid ejection head according to claim 2, wherein the silicone filler is a silicone resin filler.

4. The liquid ejection head according to claim 1, wherein the difference between the median diameter of the silica filler and the median diameter of the silicone filler is 2.0 μm or less.

5. The liquid ejection head according to claim 1, wherein a content of a dispersant in the first sealing material is 0.1% by mass or less.

6. The liquid ejection head according to claim 1, wherein the first sealing material does not contain a dispersant.

7. The liquid ejection head according to claim 1, wherein the support member has a concave portion in which a portion supporting the element substrate is recessed lower than a portion supporting the electric wiring member, and wherein the first sealing member is disposed in a gap in which an inner wall of the concave portion and a side surface of the element substrate are separated from each other.

8. The liquid ejection head according to claim 7, wherein the lead is connected to the electric connection portion of the element substrate crossing the gap, and wherein a width of the gap where the lead crosses is 1 mm or less.

9. The liquid ejection head according to claim 1, wherein the filling amount of the filler in the first sealing material is 75% by mass or less.

10. The liquid ejection head according to claim 1, wherein a use ratio of the silica filler to the silicone filler is 35 or more and 111 or less in terms of mass ratio of the silica filler to the silicone filler.

11. A method for manufacturing a liquid ejection head having an element substrate having an ejection port for ejecting liquid, an electric wiring member electrically connected to an electric connection portion of the element substrate by a lead, a support member supporting the element substrate and the electric wiring member, and a sealing member for sealing the lead and the electric connection portion, the method comprising:

applying a first sealing material to a periphery of the element substrate, and then curing the first sealing material to form a first sealing member; and applying a second sealing material above the lead and the electric connection portion, and then curing the second sealing material to form a second sealing member, wherein:

the first sealing material contains an epoxy resin, a curing agent, and a filler, the filler containing a silica filler and a silicone filler, the first sealing member has a filling amount of the filler of 40% by mass or more of the first sealing material, and a difference between a median diameter of the silica filler and a median diameter of the silicone filler is 4.0 μm or less.

12. The method for manufacturing the liquid ejection head according to claim 11, wherein the silicone filler is a silicone rubber filler, a covering type silicone filler, a silicone resin filler, or any combination thereof.

13. The method for manufacturing the liquid ejection head according to claim 12, wherein the silicone filler is a silicone resin filler.

14. The method for manufacturing the liquid ejection head according to claim 11, wherein the difference between the median diameter of the silica filler and the median diameter of the silicone filler is 2.0 μm or less.

15. The method for manufacturing the liquid ejection head according to claim 11, wherein a content of a dispersant in the first sealing material is 0.1% by mass or less.

16. The method for manufacturing the liquid ejection head according to claim 11, wherein the first sealing material does not contain a dispersant.

17. The method for manufacturing the liquid ejection head according to claim 11, wherein the support member has a concave portion in which a portion supporting the element substrate is recessed to be lower than a portion supporting the electric wiring member, and wherein the first sealing member is disposed in a gap in which an inner wall of the concave portion and a side surface of the element substrate are separated from each other.

18. The method for manufacturing the liquid ejection head according to claim 17, wherein the lead is connected to the electric connection portion of the element substrate crossing the gap and wherein a width of the gap where the lead crosses is 1 mm or less, the method comprising:

applying the first sealing material to the gap between the side surface of the element substrate and the inner wall of the concave portion of the support member other than where the lead crosses the gap to cause the first sealing material to flow into the gap where the lead crosses.

19. The method for manufacturing the liquid ejection head according to claim 11, wherein the filling amount of the filler in the first sealing material is 75% by mass or less.

20. The method for manufacturing the liquid ejection head according to claim 11, wherein a use ratio of the silica filler to the silicone filler is 35 or more and 111 or less in terms of mass ratio of the silica filler to the silicone filler.

* * * * *